US006193104B1

(12) United States Patent
Cho

(10) Patent No.: US 6,193,104 B1
(45) Date of Patent: Feb. 27, 2001

(54) BIRD NOISE LIQUID CONTAINER

(75) Inventor: Young Koo Cho, Rowland Heights, CA (US)

(73) Assignee: Howard Cho, Rowland Heights, CA (US)

( * ) Notice: Subject to any disclaimer, the term of this patent is extended or adjusted under 35 U.S.C. 154(b) by 0 days.

(21) Appl. No.: 09/398,927

(22) Filed: Sep. 17, 1999

(51) Int. Cl.[7] ..... G01F 11/00; G01F 13/00; A03H 5/00

(52) U.S. Cl. ..... 222/39; 446/216

(58) Field of Search ..... 220/212, 374, 220/368; 222/39, 192, 212, 78; 215/228, 309; 239/211, 327; 446/204, 216, 397

(56) References Cited

U.S. PATENT DOCUMENTS 4,227,482 * 10/1980 Scheindel ..... 222/39
4,674,654 * 6/1987 Fujii et al. ..... 222/39
5,213,234 * 5/1993 Stefanopoulos ..... 222/39

* cited by examiner

*Primary Examiner*—Andres Kashnikow
*Assistant Examiner*—Davis Hwu
(74) *Attorney, Agent, or Firm*—Eugene Oak

(57) ABSTRACT

A novel type of container for liquids having a spout through which as liquid passes and exits, a noise of the type made by birds, is created. The container has a vessel for holding liquid and a spout having an entry barrel attached to an exit barrel. The entry barrel is attached at its first end to the vessel and has an opening located thereon leading to a first bore. The first bore leads to a second barrel located within the exit barrel at a T-shaped intersection. The liquid passes from the first bore into the second bore and exits via a first opening of the second bore. A second opening is located opposite the first opening to facilitate the passage of water. The second bore has a first section and a second section. A curved first shoulder is formed by the connection between the first section and the first bore. A concave recess is placed on the second bore at a location opposite the first bore.

6 Claims, 2 Drawing Sheets

BIRD NOISE LIQUID CONTAINER

BACKGROUND OF THE INVENTION

I. Field of the Invention

This invention relates to a container for liquid. More specifically, the invention relates to a liquid container in which bird noise is created as liquid exits the spout.

II. Description of the Prior Art

Various different types of tubular devices exist which can be used to replicate the calls of birds and animals. These types of devices operates by a stream of air being blown into the device by a user. Passage of air in channels within the tubular devices operate to create the desired noise. These devices are not designed to operate with a stream of liquid.

Liquid containers come in all sorts of sizes and shapes. However, no liquid container has been created of the type described in the present invention.

The primary object of the present invention is to create a liquid container which produces a noise typically made by birds as liquid pours out of the container.

Another object of the present invention is to create a bird noise making liquid container which is of a relatively inexpensive and easy to manufacture.

SUMMARY OF THE INVENTION

The present invention is a novel type of container for liquids. The container of the present invention has a spout through which as liquid passes and exits, a noise of the type made by birds, is created. The container has a vessel for holding liquid and a spout having an entry barrel attached to an exit barrel. The entry barrel is attached at its first end to the vessel, and when liquid is being poured, it first enters into an opening located at the first end of the entry barrel. The opening leads to a first bore located within the first barrel. The first bore leads to a second barrel located within the exit barrel at a T-shaped intersection. The liquid passes from the first bore into the second bore and exits via a first opening of the second bore. A second opening is located opposite the first opening to facilitate the passage of water. The second bore has a first section and a second section. The first section is that portion of the second bore extending from the intersection to the first opening, and the second section is that portion of the second bore extending from the intersection to the second opening. A first shoulder is formed by the connection between the first section of the second bore and the first bore. The first shoulder should be curved.

A concave recess is placed on the second bore at a location opposite the first bore. To vary the type of bird noise one or more recesses can be placed along the surface of the second section of the second bore.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which.

DESCRIPTION OF THE PREFERRED EMBODIMENT

Figure 1:
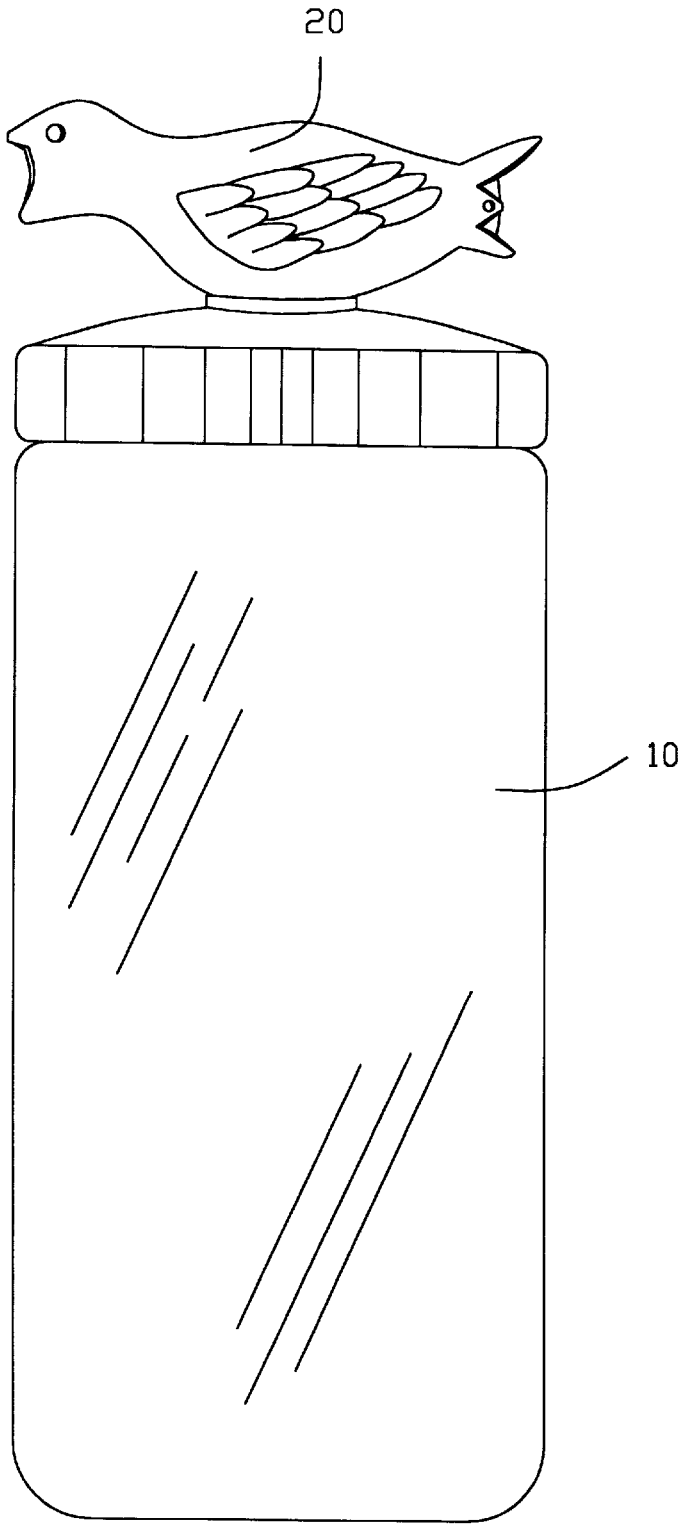
FIG. 1 is a side view of the present invention.
Figure 2:
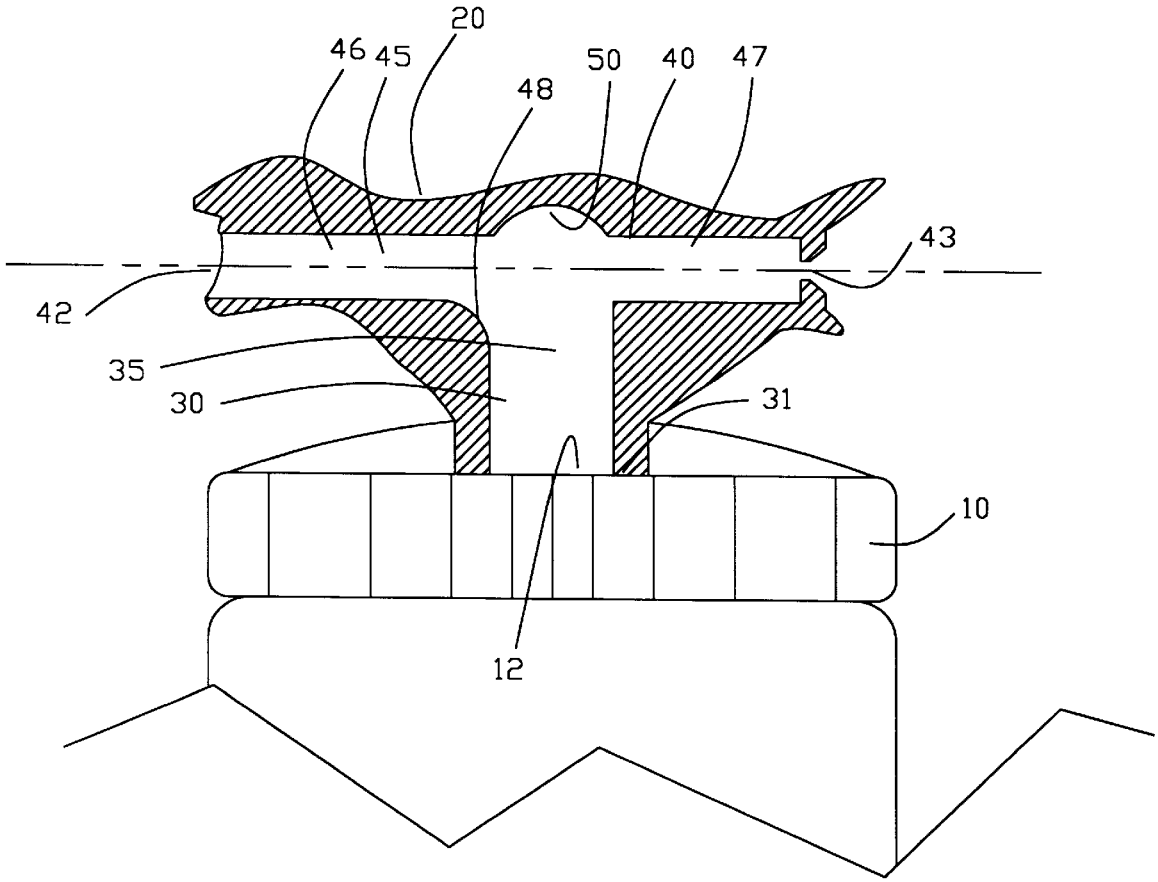
FIG. 2 is a cross sectional side view of the present invention.

As shown in FIG. 1 and 2, the present invention is a container for liquid wherein a bird-like noise is made as liquid exits the container. The container has a vessel 10 for holding liquid, and a spout 20. The spout 20 can be in the figure of any one of the various types of birds. However, the overall shape of the birds should be in T-shape form (shape of the letter "T"). The spout has two main parts, an entry barrel 30 and an exit barrel 40. The entry barrel 30, which is usually disguised as the feet of the bird, has a first end 31 which attaches to the vessel 10. An opening 12 at the first end receives liquid from the vessel 10. The opening 12 at the first end 31 leads to a first bore 35 located within the first bore 35.

The exit barrel 40 attaches to the entry barrel in a T-shaped manner. The exit barrel 40 is usually disguised as the head, body, and tail of a bird. The exit barrel 40 has an inner second bore 45 having a smooth surface. The second bore 45 also has a first opening 42 from which liquid can exit and a second opening 43 opposite the first opening 42. The second opening 43 should be of a diameter much smaller than the diameter of the first opening. The second opening should have a diameter ranging from eight to 20 times smaller than the diameter of the first opening. Also, the second opening is preferably funnel shaped with the narrow portion being toward the inner portion of the second opening and widening toward the outer portion of the second opening.

The first bore 30 intersects the second bore 40 to form a T-shaped intersection and divides the second bore 40 into two sections, namely a first section 46 and a second section 47. The first section 46 is that portion of the second bore 45 extending from the intersection to the first opening 42, and the second section 47 is that portion of the second bore 45 extending from the intersection to the second opening 43. A first shoulder 48 is formed by the connection between the first section 46 of the second bore 45 and the first bore 35. The first shoulder 48 should be curved. Varying the amount of curvature of the first shoulder 48 will vary the type of bird noise. A second shoulder 49 is formed by the connection between the second section 47 of the second bore 45 and the first bore 35. In the preferred embodiment, the second shoulder is not curved.

A concave recess 50 should be placed on the surface of the second bore 45 at a location opposite the first bore 35. The size and depth of the concave recess 50 can be varied to modify the type of bird noise. Also, one or more additional concave recesses can be placed within the concave recess 50 to vary the type of bird noise.

To further vary the type of bird noise one or more recesses can be placed along the surface of the second section 47 of the second bore 45.

What is claimed is:

1. A container for liquid comprising:

a vessel for holding liquid;

a T-shaped spout comprising of an entry barrel and an exit barrel;

said entry barrel having a first end attached to said vessel, an opening at said first end for receiving a liquid leading to a first bore;

an exit barrel attached to said entry barrel in a T-shaped manner, said exit barrel having an inner second bore with a smooth surface, said second bore having a first opening from which liquid can exit and a second opening opposite said first opening;

said first bore intersecting said second bore to form a T-shaped intersection and dividing said second bore into two sections, namely a first section and a second section, said first section extending from the intersection to the first opening, said second section extending from the intersection to the second opening, a first shoulder wherein said first bore connects to said first section, said first shoulder being curved; and, a concave recess disposed on the surface of the second bore at a location opposite said first bore.

2. The container as described in claim 1 further comprising one or more recesses disposed on said surface of said second section of said second bore.

3. The container as described in claim 1 wherein said second opening has a funnel shape.

4. A T-shaped spout for a liquid container comprising an entry barrel and an exit barrel;

said entry barrel having a first end for attachment to a liquid container, an opening at said first end for receiving a liquid leading to a first bore;

an exit barrel attached to said entry barrel in a T-shaped manner, said exit barrel having an inner second bore with a smooth surface, said second bore having a first opening from which liquid can exit and a second opening opposite said first opening;

said first bore intersecting said second bore to form a T-shaped intersection and dividing said second bore into two sections, namely a first section and a second section, said first section extending from the intersection to the first opening, said second section extending from the intersection to the second opening, a first shoulder wherein said first bore connects to said first section, said first shoulder being curved; and, a concave recess disposed on the surface of the second bore at a location opposite said first bore.

5. The container as described in claim 4 further comprising one or more recesses disposed on said surface of said second section of said second bore.

6. The container as described in claim 4 wherein said second opening has a funnel shape.

* * * * *